United States Patent [19]

Voegelin

[11] 4,173,185

[45] Nov. 6, 1979

[54] SCREEN PRINTING APPARATUS

[75] Inventor: Heinrich Voegelin, Wiler b. Utzenstorf, Switzerland

[73] Assignee: Fritz Buser Ag. Maschinenfabrik, Switzerland

[21] Appl. No.: 841,479

[22] Filed: Oct. 12, 1977

[30] Foreign Application Priority Data

Oct. 19, 1976 [CH] Switzerland ..... 13240/76

[51] Int. Cl.[2] ..... B41F 15/42; B41F 15/46

[52] U.S. Cl. ..... 101/120; 101/124; 101/365

[58] Field of Search ..... 101/123, 124, 115, 119, 101/120, 365

[56] References Cited

U.S. PATENT DOCUMENTS

| | | | |
|---|---|---|---|
| 2,793,586 | 5/1957 | Arelt | 101/123 |
| 3,934,502 | 1/1976 | Marino | 101/115 |
| 4,038,919 | 8/1977 | Lotte | 101/120 |

FOREIGN PATENT DOCUMENTS 449664 4/1968 Switzerland .

*Primary Examiner*—Clyde I. Coughenour

*Attorney, Agent, or Firm*—Roylance, Abrams, Berdo & Farley

[57] ABSTRACT

A squeege structure for a screen stencil of a printing machine comprises an elongated carrier frame and a squeegee coupled to the carrier frame by a thrust drive for moving the squeegee between operative and nonoperative positions. The thrust drive includes a central first thrust drive unit and a plurality of second thrust drive units mounted on each side of the first thrust drive unit. The movable portion of the first thrust drive unit may only move along its thrust axis which is in a direction perpendicular to the longitudinal axis of the carrier frame and is restrained from moving in a direction perpendicular to the thrust axis. The movable members of the second thrust drive units may move along their thrust axes and may also move in a direction perpendicular to the thrust axis and parallel to the longitudinal axis of the carrier frame, but may not move in a direction perpendicular to both the thrust axis and the carrier frame longitudinal axis. This structure permits the first and second thrust drive units to be flexibly coupled to compensate for deflection of the carrier member to avoid seizing of the first and second thrust drive units and provide uniform pressure along the entire length of the squeegee.

9 Claims, 5 Drawing Figures

SCREEN PRINTING APPARATUS

BACKGROUND OF THE INVENTION

The present invention relates to a squeegee structure for a screen printing frame and which is built into a printing station of a screen printing machine. The squeegee mountings, together with the squeegee of the arrangement, is held on the printing material supply side of the printing screen by means of a number of thrust piston drives so that they may be raised and lowered. The drives are distributed over the printing area, activated by a pressure medium, and braced by a squeegee support at the printing station.

There are known squeegee arrangements for planar and for rotational screen printing machines in which squeegee supports are mounted at the printing stations, with a number of thrust piston drives activated by a pressure medium being fastened to the supports. The thrust piston drives are designed either as single acting or double acting cylinder-piston units, whose piston rods are connected with each other by a squeegee extending the width of the printing area.

Since the squeegee must be pressed with a certain force against the printing material supply side of the screen stencil, the thrust piston drives must be braced against the squeegee support. This causes the support to bend. The support may not be made as stiff as desired because of the generally limited available space. The arrangement of the thrust piston drive is such that a similar bending of the squeegee mounting is avoided. However, it is unavoidable that the piston thrust drives follow the bending of the support or carrier frame, with the result that the piston thrust drive can become misaligned and seized.

The piston thrust drives can be so designed that they lift the squeegee off the screen upon interruption of the printing operation. For simply operating piston-cylinder units, a spring is included therein for this purpose. The spring is under load during the printing operation and, when the operation is discontinued lifts the piston with piston rod and the squeegee holder attached thereto from the screen stencil.

For cylindrical stencils printing screens, it is necessary in changing the silk screening screen that the squeegee structure penetrating the inside of the screen printing stencil be disassembled. Only then can the screen be replaced by another.

The object of the invention is to devise a squeegee structure of the type described above which prevents seizing of the piston thrust drive caused by bending of the thrust drive support, without, however, having to sacrifice thereby the advantage of easy removal and replacement of the squeegee structure.

SUMMARY OF THE INVENTION

This object is realized in accordance with the invention in that the squeegee mounting and thrust piston drives are connected to each other in an at least partially flexible, movable or adjustable manner.

The invention is illustrated in the form of several embodiments in the accompanying drawing and described below.

DESCRIPTION OF THE PREFERRED EMBODIMENTS

Figure 1A:
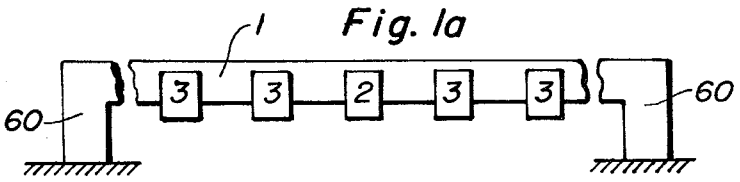
FIG. 1a is a graphical illustration of the arrangement of the thrust drive units on the squeegee structure of the present invention.
Figure 1:
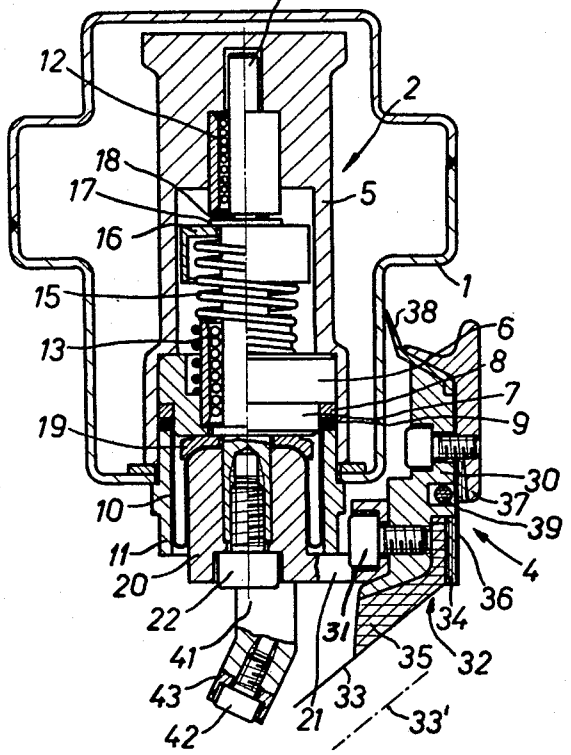
FIG. 1 is a cross-sectional view of the squeegee structure according to one embodiment of the present invention illustrating the details of the central or first drive unit.

The squeegee structure of FIG. 1*a* comprises a hollow, elongated carrier frame 1, which is designed in a box configuration and supported at its ends on both sides of the printing material by supports 60. A squeegee mounting 4 is movably coupled to the carrier frame 1 by a number of thrust piston drives 2,3 arranged in a spaced manner. Two different types of the thrust piston drives are provided, namely the central thrust piston drive 2 of FIG. 1 and the sideways thrust piston drive 3 of FIG. 2. The thrust piston drives 2,3 are suitably connected with the carrier frame 1 by, for instance, a clamp connection.

The thrust piston drive 2 features a housing 5 in which there is fastened a bottom 6 by, for instance, the use of mating threads. The bottom 6 has a shoulder 7 which forms an annular groove together with the wall of the housing 5. The thickened lip portion 9 of a piston diaphragm 10 is seated in the groove together with a ring 8 and held in place by a threaded insert 11 having an inner contact surface for the piston diaphragm 10.

In the upper portion and in the bottom 6 of the housing 5, respectively, are two longitudinal ball bearing assemblies 12,13 which axially guide the piston rod 14. A compression spring 15 between the bearing assemblies 12,13 presses at one end against the bottom 6 and at the other end against a spring plate 16. The spring plate 16, in turn, pushes against a pressure plate 17 which rests against a split ring 18 seated in a groove of the piston rod 14.

The piston diaphragm 10 is connected to the piston rod 14 at the end opposite its lip portion 9. For this, the piston diaphragm 10 is clamped between a contact plate 19, which is fastened to the piston rod 14, and the hub 20 of a support arm 21. The clamping force for diaphragm 10 and the fastening of the hub 20 to the piston rod 14 is by a cap screw 22 which is screwed into the end of the piston rod 14. Since the support arm 21 extends perpendicularly to the squeegee mounting 4, the squeegee mounting 4 is displaced with respect to the axis of movement (i.e., thrust axis) of the thrust piston drives 2,3.

Figure 2:
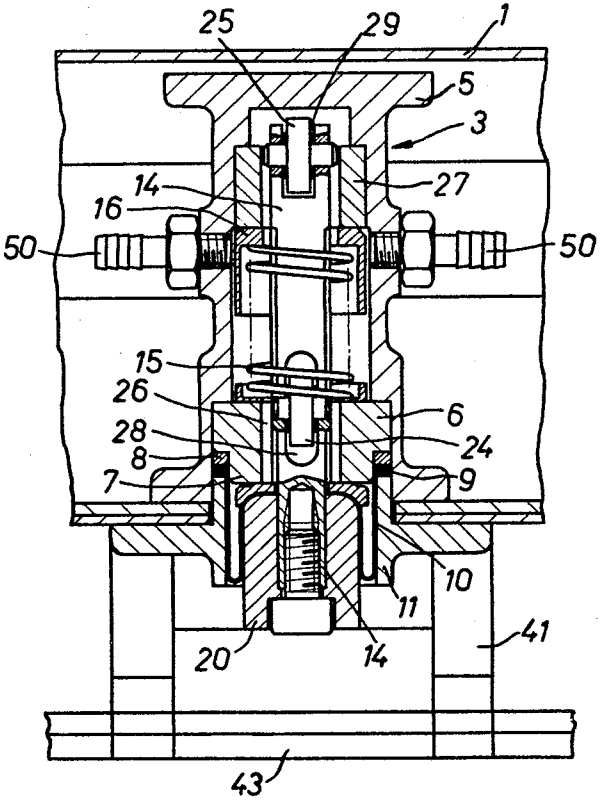
FIG. 2 is a cross-sectional view of the squeegee structure according to the embodiment of FIG. 1 of the present invention illustrating the details of a second or sideways thrust drive unit.

The sideways thrust piston drive 3 illustrated in FIG. 2 has the same parts as the central thrust piston drive 2, with the exception of the longitudinal bearing assemblies. Therefore the same reference numerals are associated with similar features. The piston rod 14 of FIG. 2 is guided by two rollers 24 and 25 instead of the longitudinal bearing assemblies 12,13 of the central thrust piston drive 2. The rollers 24 and 25 are guided in a bore 26 in the bottom 6. The roller 25 is guided in a ring 27 in the interior of the housing 5. The rollers 24, 25 are supported in an indentation 28 and in a slot 29 in the piston rod 14 so that they may rotate.

For every squeegee, there is a central thrust piston drive 2 in the middle. To both sides of this are arranged a sufficient and equal number of sideways thrust piston drives 3 to space them evenly along the entire length of the carrier frame 1. When the carrier frame 1 bends, the piston rods 14 of the sideways thrust piston drives 3 can yield somewhat. They are thereby flexible, so that no seizing arises when the carrier frame 1 is deformed. The sideways guiding is provided by the bearings 12,13 of the thrust piston drive 2, while that required in the direction of printing material movement is provided by the bearings 12, 13 of the thrust piston drive 2 as well as by the rollers of the sideways thrust piston drives 3.

The squeegee mounting is made up of essentially the supporting arm 21 and the squeegee mounting bracket 30. Each support arm 21 is fastened in the middle to the mounting bracket 30 by two screws 31.

The mounting bracket 30 carries a clamping arrangement for the squeegee 33, which is held between clamping sheets 34,35 and flat clamping sheet 36. The flat clamping sheet 36, in turn, is itself held between the mounting bracket 30 and a clamping bracket 37. A lip seal 38 and an elastic gasket cord 39 complete the squeegee mounting 4.

On the underside of the carrier frame 1 is a protective arrangement consisting of two mountings 41 and a protective bar 43 attached thereto by screws 42. The protective arrangement 41,42,43 is designed so that the squeegee 33 is protected when the thrust piston drives 2,3 are not under pressure and the squeegee 33 is in the raised position illustrated in FIG. 1. The broken line 33' shows the location of the squeegee 33 in its lowered, operative position. By this arrangement, the carrier frame 1 can be disassembled and assembled without the risk of damage to the squeegee 33.

Figure 3:
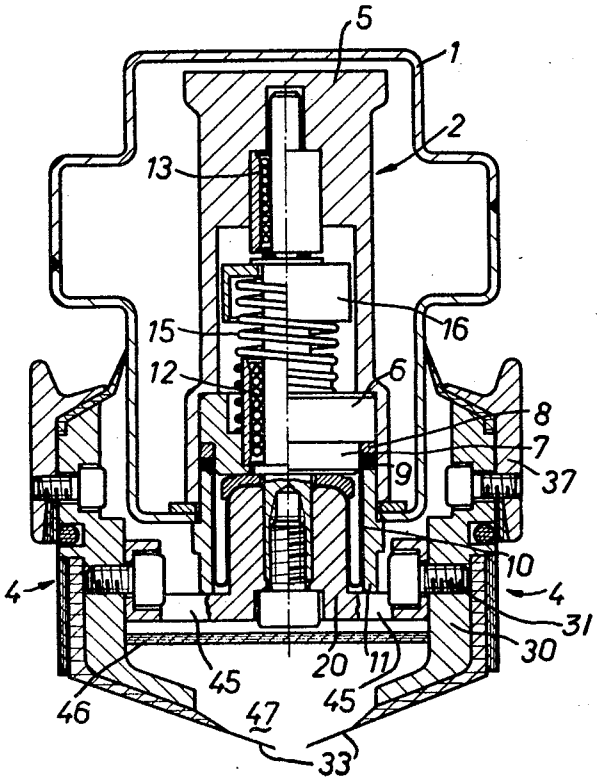
FIG. 3 is a cross-sectional view of a squeegee structure according to a second embodiment of the present invention illustrating the details of the central or first drive unit.

A further embodiment of a squeegee structure is shown in FIG. 3. The carrier frame 1 and the central thrust piston drive 2 correspond to that shown in FIG. 1. However, the hub 20 now has two opposing support arms 45 which each carry a squeegee mounting 4. The two squeegee mountings 4 oppose each other, and together with the cover 46 form a pressure chamber which is also closed on the sides by means not shown. Because of the offset location of the squeegee mounting 4, it is possible to complete the squeegee mounting 4 by a slot in the printing squeegee.

Figure 4:
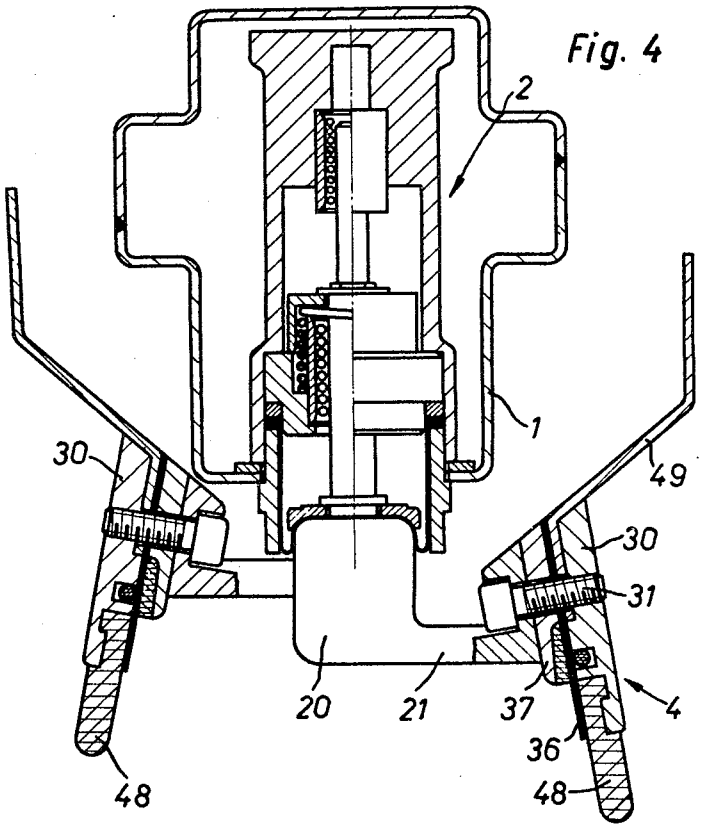
FIG. 4 is a cross-sectional view of a squeegee structure according to a third embodiment of the present invention illustrating the details of the central or first thrust drive unit.

In FIG. 4 is seen a further embodiment of the squeegee structure which may be used for flat screen printing machines. In this embodiment two separately arranged squeegee mountings 4 are fastened to the carrier frame 1 and may be independently operated. This arrangement is achieved by disposing the support arms 21 in alternating opposite directions. It is thereby possible to use two squeegee mounting brackets 30 with each having one rubber squeegee 48.

The fastening of the rubber squeegee 48 is accomplished by a clamping arrangement similar to that of the squeegee 33, that is, by means of a clamping sheet 36 and a clamping bracket 37. A cover 49 completes the squeegee mounting 4.

The operation of the squeegee structure is controlled by pressurizing or depressurizing the thrust piston units 2,3. Pressure connections 50 (FIG. 2) permit the inflow and outflow of a pressure medium, e.g., air. When the thrust piston drives 2,3 are pressure activated the squeegees 33 are pressed into operating position; that is, against the back side of the screen stencil (not shown). When the thrust piston drives 2,3 are depressurized, the squeegees 33 are raised by the compression springs 15. If the protective arrangement 41–43 is used, then the squeegee 33 is protected and as a practical matter cannot be damaged in assembly and disassembly. In the embodiment of FIG. 3 the two oppositely oriented squeegees 33 provide a certain degree of protection against damage. For the embodiment of FIG. 4, a protective arrangement is less required, since in a flat screen printing machine there is sufficient space for assembly and disassembly of the wiper arrangement.

The squeegee structure of the present invention is versatile in that it may be adapted for various embodiments. By the use of a central thrust piston drive 2 and at least two sideways thrust piston drives 3, the seizing upon deformation of the carrier frame 1 can be largely prevented.

While certain advantageous embodiments have been chosen to illustrate the invention, it will be understood by those skilled in the art that various changes and modifications can be made therein without departing from the scope of the invention as defined in the appended claims.

What is claimed is:

1. A squeegee structure for a screen stencil of a printing machine in which the material to be printed is moved along a feed axis comprising a relatively stationary, elongated carrier frame having a longitudinal axis;

a first squeegee mounting means;

thrust drive means coupled to said carrier frame and said mounting means for moving said mounting means toward and away from a surface of a screen stencil and along a thrust axis which is perpendicular to the feed axis and said longitudinal axis, said thrust drive means comprising at least one first thrust drive unit and a plurality of second thrust drive units, said first thrust drive unit being located approximately at a longitudinal midpoint of said carrier frame, at least one of said second thrust drive units being located on each side of said first thrust drive unit;

each of said first and second thrust drive units having a relatively stationary portion fixed to said carrier frame, a relatively movable portion movably coupled to said stationary portions, and bearing means between said stationary and movable portions for guiding said movable portions; said bearing means of said first thrust drive unit guiding said movable portion thereof for movement along said thrust axis and for preventing movement of said movable portion in directions perpendicular to said thrust axis; said bearing means of said second thrust drive units guiding said movable portions thereof for movement along said thrust axis, for permitting movement in a direction perpendicular to said thrust axis and parallel to said longitudinal axis, and for preventing movement in a direction perpendicular to said thrust axis and said longitudinal axis; and a first squeegee coupled to said mounting means;

whereby said first and second thrust drive units are flexibly coupled to compensate for deflection of said carrier member to avoid seizing of said first and second thrust drive units and provide uniform pressure along the entire length of the squeegee.

2. A squeegee structure according to claim 1, wherein a second squeegee mounting means and a second squeegee are coupled to said thrust drive means and arranged in opposition to said first squeegee mounting means and said first squeegee, said squeegees are offset relative to said thrust axis.

3. A squeegee structure according to claim 1, wherein a second squeegee mounting means and a second squeegee are movably coupled to said carrier frame by an additional thrust drive means to permit independent operation of said first and second squeegees, said squeegees are offset relative to said thrust axis.

4. A squeegee structure according to claim 1, wherein said stationary portions are cylinders and said movable portions are pistons which are fluid pressure operated.

5. A squeegee structure according to claim 4, wherein said pistons and cylinders are coupled by flexible diaphragms.

6. A squeegee structure according to claim 1, wherein said bearing means for each of said second thrust drive units comprises one roller rotatably mounted at each end of its movable portion, each roller being guided by its stationary portion.

7. A squeegee structure according to claim 1, wherein an equal number of second thrust drive units are provided on each side of said first thrust drive unit.

8. A squeegee structure according to claim 1, wherein said first and second thrust drive units are evenly spaced along the entire length of said carrier frame.

9. A squeegee structure according to claim 1, wherein a protective bar is suspended from said carrier frame adjacent said mounting means and squeegee and is located below said squeegee only when said squeegee is in an inoperative position away from the surface of a screen stencil.

* * * * *